US008776425B2

(12) United States Patent
Pelin

(10) Patent No.: US 8,776,425 B2
(45) Date of Patent: Jul. 15, 2014

(54) METHOD FOR PRODUCING A GUN BARREL, DEVICE FOR PRODUCING A GUN BARREL AND A GUN BARREL

(75) Inventor: Torolf Pelin, Jorvas (FI)

(73) Assignee: Carrel Innovations Oy, Jorvas (FI)

( * ) Notice: Subject to any disclaimer, the term of this patent is extended or adjusted under 35 U.S.C. 154(b) by 120 days.

(21) Appl. No.: 13/384,416

(22) PCT Filed: Jul. 15, 2010

(86) PCT No.: PCT/FI2010/000046

§ 371 (c)(1),
(2), (4) Date: Jan. 17, 2012

(87) PCT Pub. No.: WO2011/012766

PCT Pub. Date: Feb. 3, 2011

(65) Prior Publication Data

US 2012/0110885 A1 May 10, 2012

(30) Foreign Application Priority Data

| | | |
|---|---|---|
| Jul. 17, 2009 | (FI) | 20090277 |
| Oct. 6, 2009 | (FI) | 20090369 |
| Mar. 23, 2010 | (FI) | 20100126 |

(51) Int. Cl.
*F41C 27/00* (2006.01)

(52) U.S. Cl.
USPC ..... 42/76.1; 42/78; 72/57

(58) Field of Classification Search
USPC ..... 42/76.01–76.1; 72/57, 58, 96
See application file for complete search history.

(56) References Cited

U.S. PATENT DOCUMENTS

| | | | | |
|---|---|---|---|---|
| 1,339,023 | A * | 5/1920 | Cole | 72/90 |
| 1,982,369 | A | 11/1934 | Brinkman | |
| 2,397,544 | A * | 4/1946 | Garand | 72/96 |
| 3,107,450 | A | 10/1963 | Snyder et al. | |
| 4,622,080 | A | 11/1986 | Wegwerth | |
| 5,590,485 | A | 1/1997 | Brandl | |

FOREIGN PATENT DOCUMENTS

| | | |
|---|---|---|
| DE | 4439204 | 6/1995 |
| EP | 0727637 | 8/1996 |
| GB | 191003510 | 2/1910 |
| GB | 581974 | 10/1946 |
| WO | 9412843 | 6/1994 |

OTHER PUBLICATIONS

International Search Report dated Dec. 21, 2010, corresponding to PCT/FI2010/000046.

* cited by examiner

*Primary Examiner* — Samir Abdosh
(74) *Attorney, Agent, or Firm* — Young & Thompson

(57) ABSTRACT

A method for producing a gun barrel, in which the barrel is formed from a pipe blank (1) in which barrel rifles (2) are formed against a mandrel (3) having grooves (**2*b***) shaped as the rifles.

8 Claims, 10 Drawing Sheets

METHOD FOR PRODUCING A GUN BARREL, DEVICE FOR PRODUCING A GUN BARREL AND A GUN BARREL

This invention relates to a method for producing a gun barrel by forming the barrel from a pipe blank.

Gun barrels are currently made of metal. A hole is drilled in a metal blank, such as an elongated shaft, and the hole is provided with rifles by trimming, "Broach Rifling", hammering "Hammer Forget Rifling", or a button drawing technique called "Button Rifling". A fourth previously known method uses electrochemical engraving, called "Electrochemical Rifling".

The purpose of this invention is to achieve a perfectly straight and durable gun barrel produced by a completely new method. This production method is considerably faster than all the methods for producing gun barrels known per se. The method in accordance with the invention is characterised by the fact that barrel rifles are formed in a pipe blank using moulding techniques against a mandrel having grooves shaped as the rifles.

The invention also relates to a device for producing a gun barrel. The device in accordance with the invention is characterised by the fact that the device consists of press means, whose press force together with a movement generated outside the pipe blank achieves a deformation of the pipe blank by moulding techniques, so that barrel rifles having the shape of the grooves in the mandrel are produced in the inner wall of the pipe blank.

The invention also relates to a gun barrel, which is characterised by the fact that the pipe blank is provided with a support pipe, which gives the barrel strength and resistance.

Various embodiments of the invention are set forth in the dependent claims of the set of claims.

Figure 1:
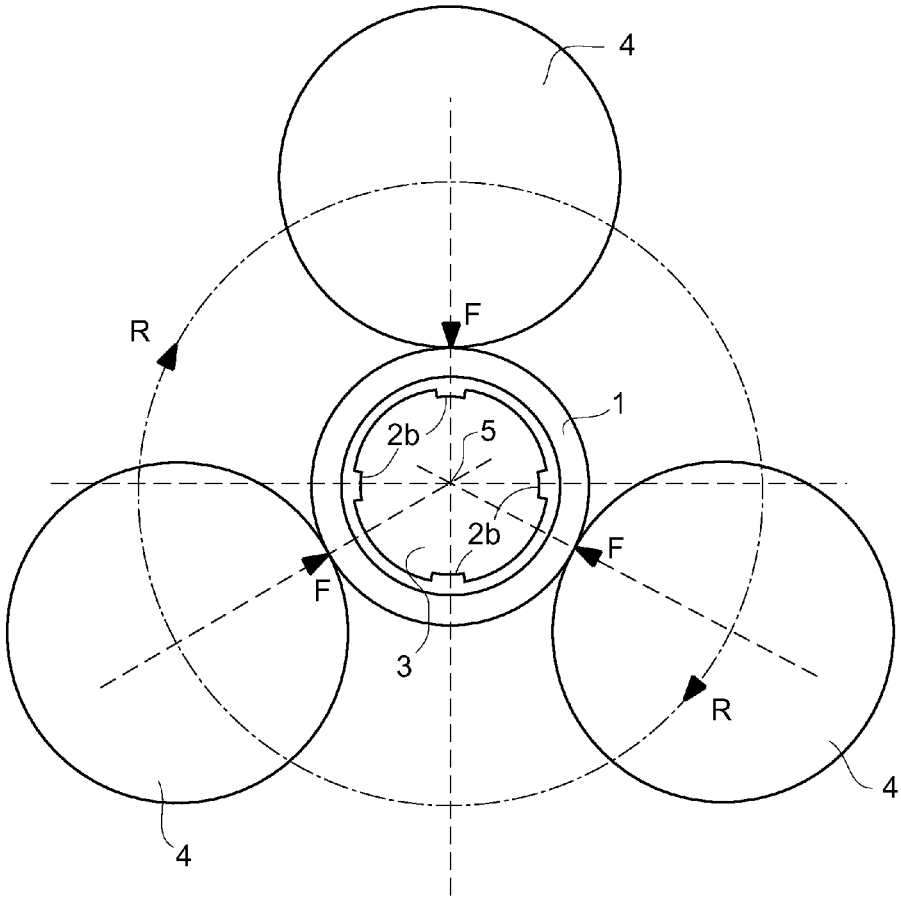
Figure 2:
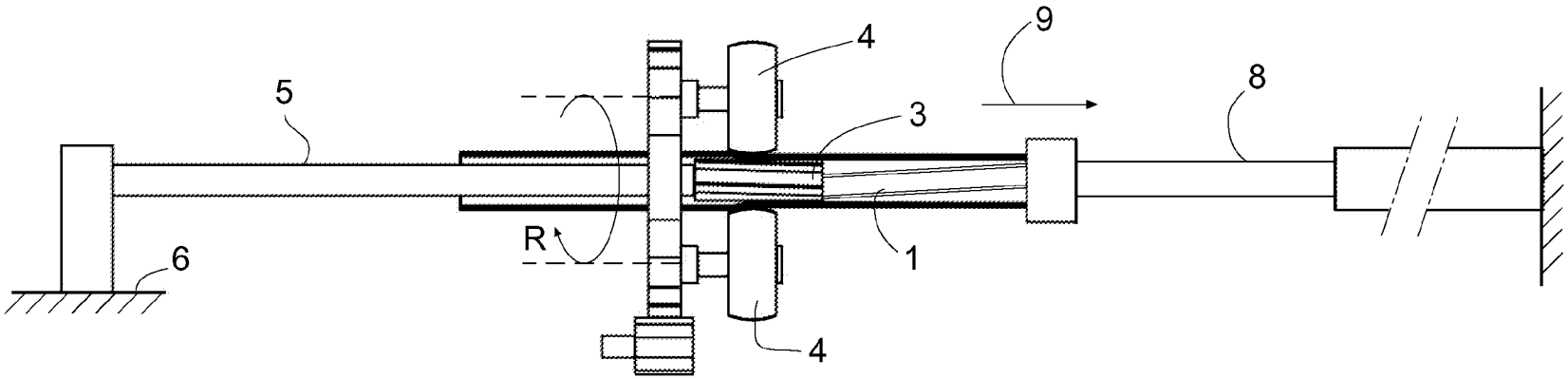
Figure 3:
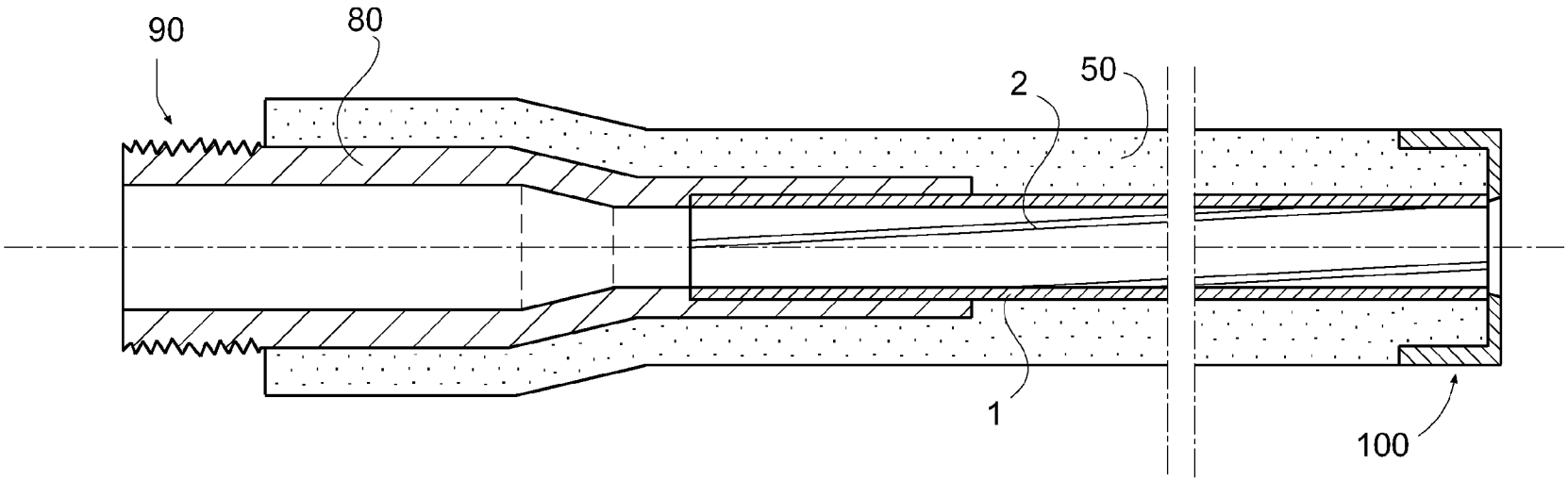
Figure 4:
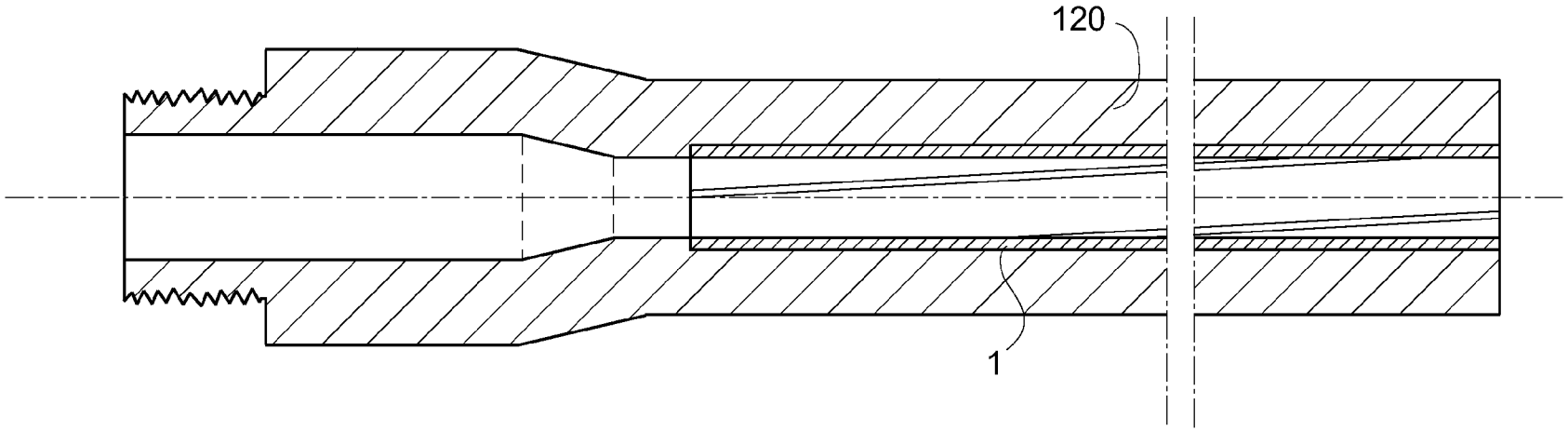
Figure 5:
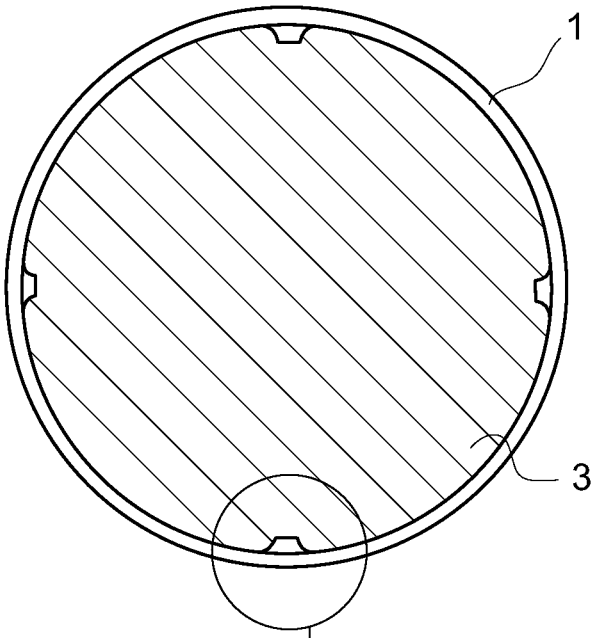
Figure 6:
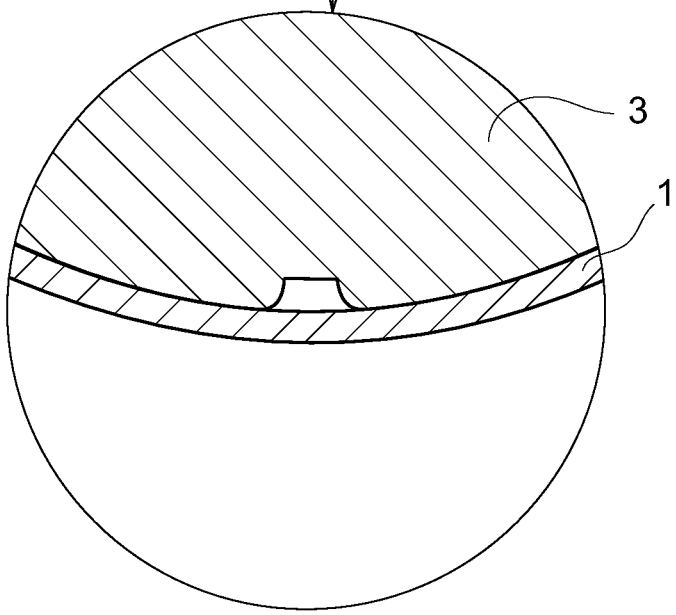
Figure 7:
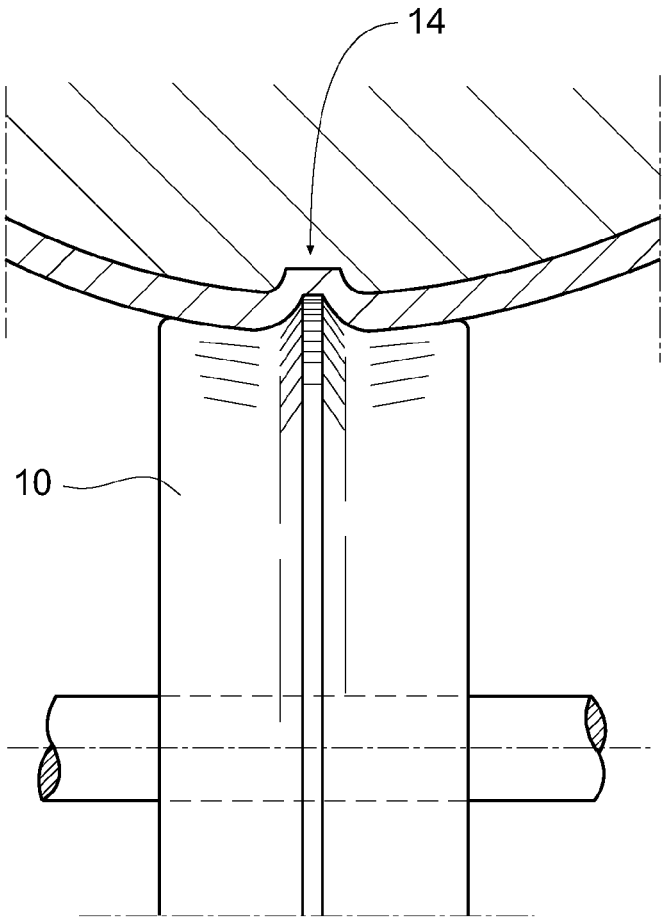
Figure 8:
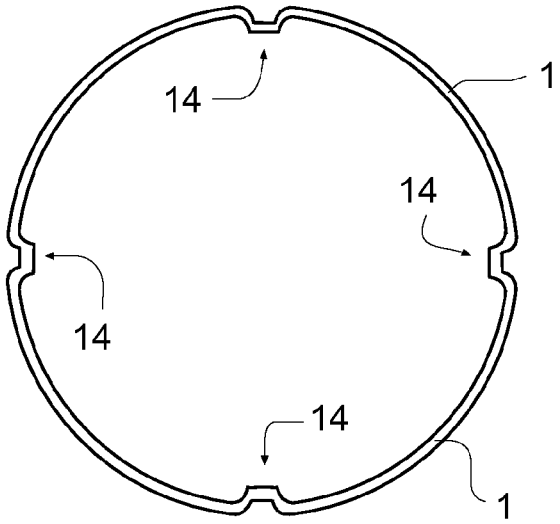
Figure 9:
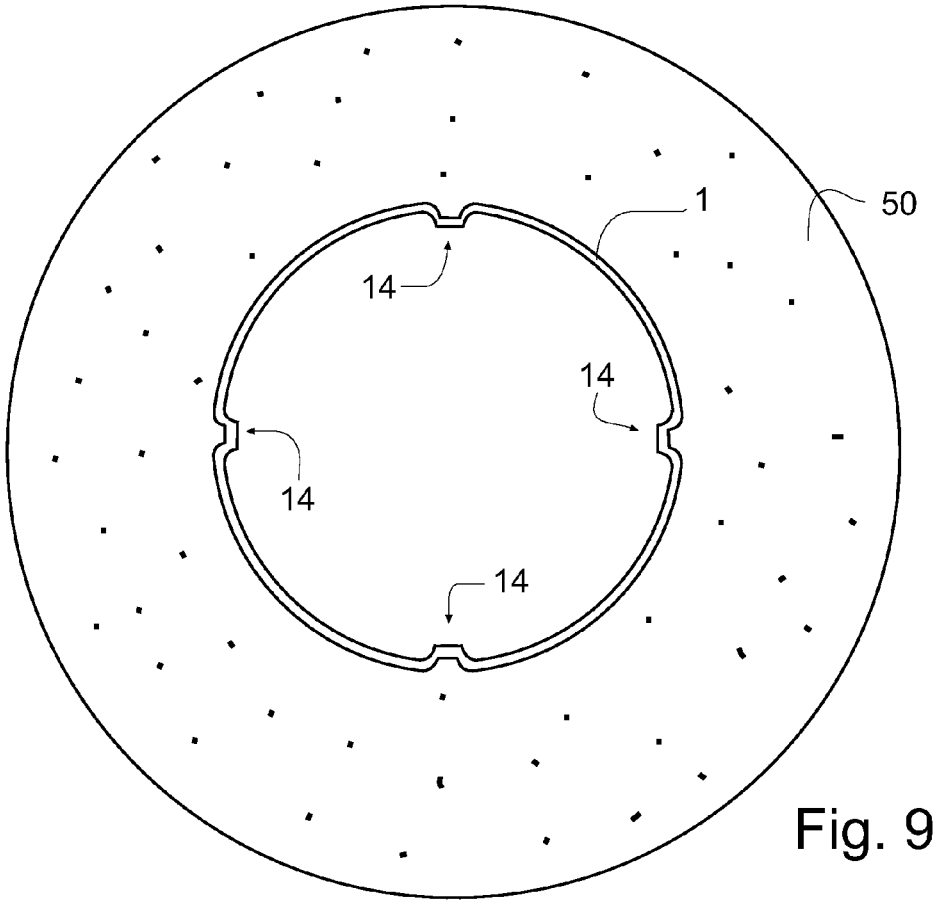
Figure 10A:
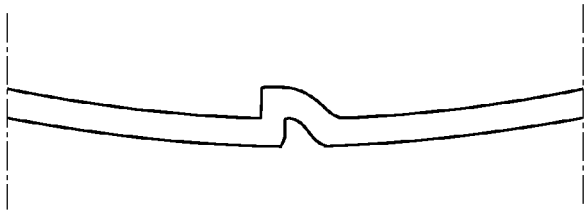
Figure 10B:
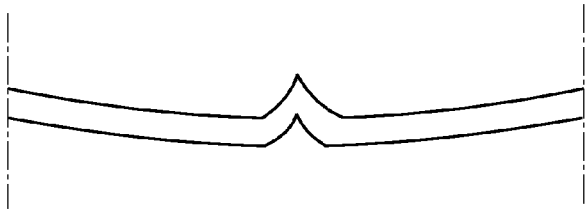
Figure 11:
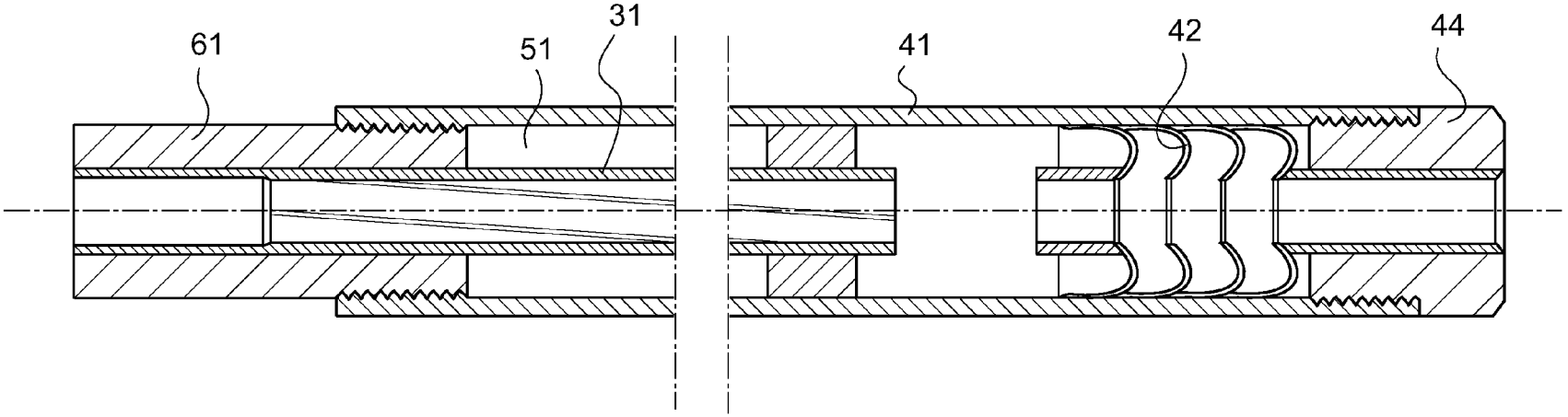
Figure 12:
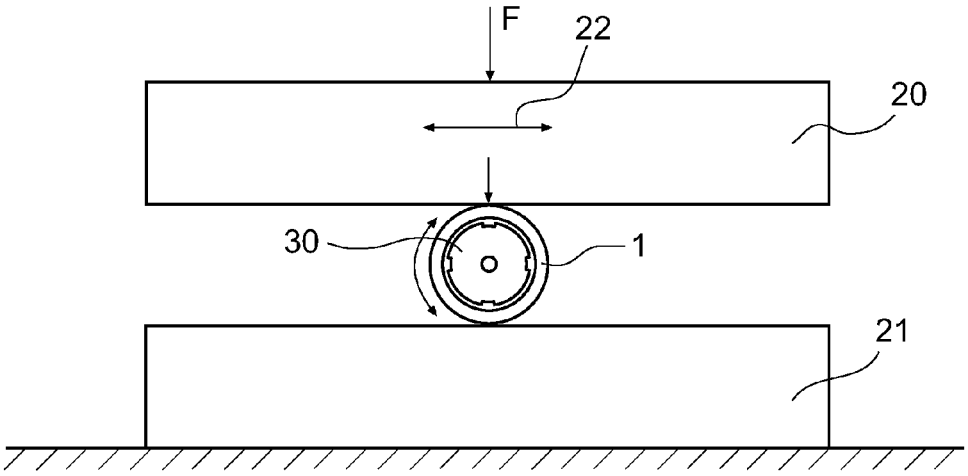
Figure 13:
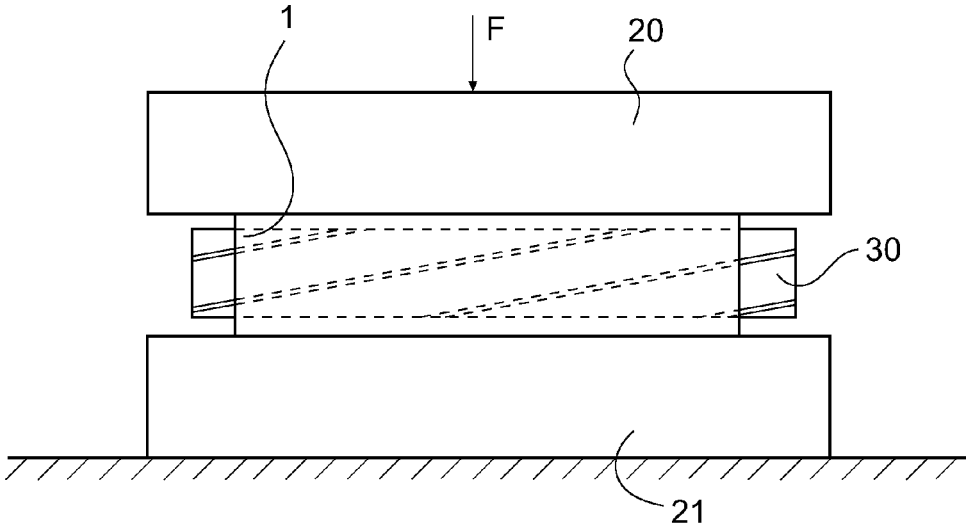
Figure 14:
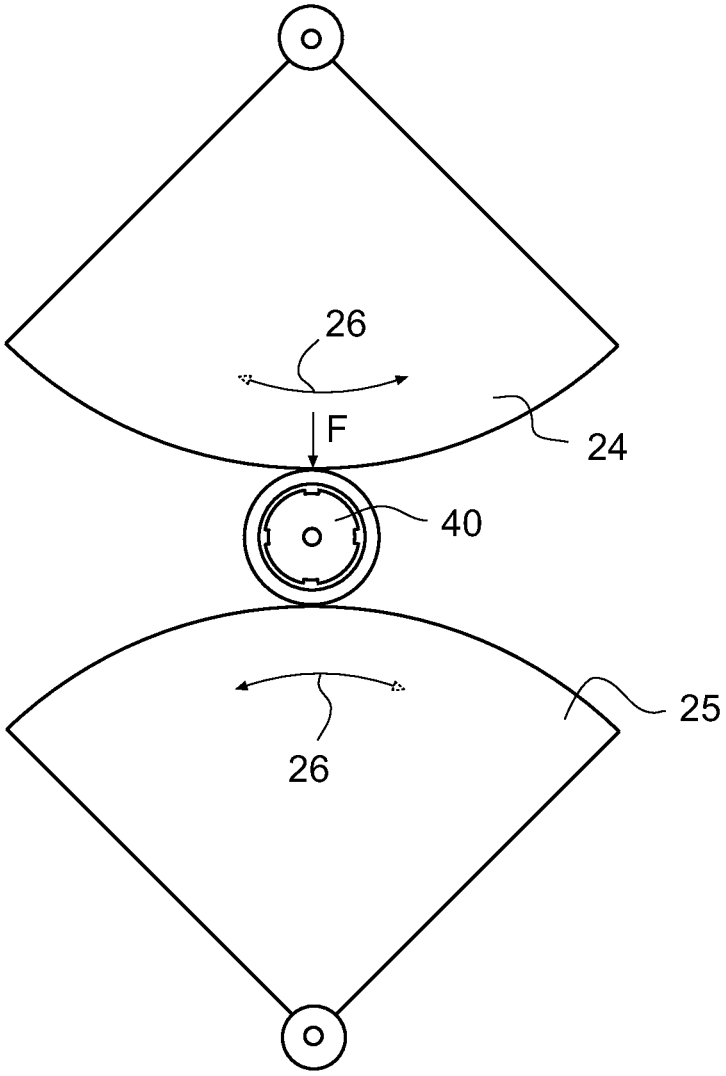

The invention is described below by means of an example and with reference to the accompanying drawings, in which FIG. 1 shows moulding of a pipe blank for a gun barrel using press rolls, viewed in the longitudinal direction of the pipe blank, FIG. 2 is a lateral view of the essential parts of the machine required for the production of the gun barrel using press rolls, FIG. 3 is a longitudinal sectional view of one embodiment of the gun barrel, FIG. 4 is a sectional view of a second embodiment of the gun barrel, FIG. 5 illustrates a metal tube mounted on a mandrel, FIG. 6 is an enlargement of the ring of FIG. 5, FIG. 7 shows the moulding of a rifle, with a press roll moving in parallel with the rifle, FIG. 8 shows a barrel pipe with four rifles moulded by the method illustrated in FIG. 7, FIG. 9 shows a barrel pipe, on top of which a support pipe made of e.g. carbon fibre or glass fibre has been produced, FIGS. 10*a* and 10*b* show rifles with different shapes, FIG. 11 shows a barrel with a sound damper integrated in its external support pipe, FIG. 12 shows the moulding of a pipe blank between two planes, FIG. 13 illustrates the same as FIG. 12, viewed from another direction and FIG. 14 illustrates the moulding of a pipe blank between two curved planes reciprocating into opposite directions.

THE METHOD

Barrel rifles are moulded in a seamless pipe blank of stainless or acid-proof steel for a gun barrel using moulding techniques against a mandrel 3, which is provided with grooves 2*b* shaped as the rifles 2. The moulding in FIGS. 1 and 2 is performed with the aid of press rolls 4. The press rolls 4 are substantially perpendicular to the longitudinal axis 5 of the pipe blank 1. The press rolls 4 are rotated around the pipe blank 1, so that the wall of the pipe blank is pressed against the mandrel 3 and barrel rifles 2 are produced in the inner wall of the pipe blank. The pipe blank 1 is pulled over the mandrel 3 and the press rolls R are simultaneously rotated around the pipe blank while being pressed F against the mandrel 3. The press force F is generated by means of technical solutions known per se, such as eccentric pieces.

The moulding of a barrel blank 1 in FIG. 7 is performed by means of press rolls 10. The press rolls follow the same direction as the rifles 14. FIG. 8 shows a finished barrel pipe and FIG. 9 shows a barrel pipe equipped with a support pipe 50, which may be made of carbon fibre, glass fibre or any other fibre reinforcement known per se, or an additional supporting metal tube.

The moulding of the barrel blank 1 in FIGS. 12 and 13 is performed between two planes 20, 21. The upper plane reciprocates in the direction of the arrow 22. The plane 22 presses the pipe blank 1 rotating between the planes and the mandrel 30 with a force F. The grooves provided in the mandrel 30 are reproduced as rifles in the pipe blank 1. FIG. 13 shows that the mandrel 30 is longer than the pipe blank. There are two reasons for this: a) the pipe blank 1 extends in the course of the moulding, b) the mandrel 30 will not require shifting in the longitudinal direction during the moulding. After the moulding step has been completed, the mandrel 30 is removed and the barrel is ready to be mounted in a gun, such as a pistol, or the cartridge chamber of a pistol.

The moulding in FIG. 14 is on principle performed in the same manner as in FIGS. 12 and 13, but the two planes 24, 25 are both curved and move alternately into opposite directions, as indicated by arrows 26, with the pipe blank 1 and the mandrel 30 placed between the planes rotating in a stationary position, and if necessary, mounted onto bearings at both ends.

The Device

The embodiment of a device for producing a gun barrel shown in FIGS. 1 and 2 consists of press rolls 4, which generate a press force F, which in a rotatory movement R around the pipe blank and using moulding techniques produces a deformation in the pipe blank, so that barrel rifles 2 in a shape corresponding to the grooves 2*b* in the mandrel are produced in the inner wall. The mandrel 3 is stationary and attached to a base 7 by means of an elongated shaft 6, and the pipe blank 1 can be pulled by a drawing device 8 over the mandrel 3 in the direction indicated by the arrow 9. The press rolls 4 rotate around the pipe blank while the drawing device 8 pulls the pipe blank 1 in the direction indicated by the arrow 9. Tests producing bores 308 and 22LR have proved that the method and the device achieve first-class, perfectly straight gun barrels, rapidly and at low cost. The tests used acid-proof AISI316 steel.

Gun Barrel

The gun barrel in FIG. 3 is equipped with a support pipe 50, which gives the barrel strength and resistance. The support pipe 50 may consist of carbon fibre, glass fibre or carbon nanotube-reinforced epoxy (Hybtonit®). The gun barrel is fixed to the cartridge chamber 80. The cartridge chamber has threads 90 for attachment of the gun barrel to the bolt housing. A metal ring 100 is provided in the front part of the barrel for protection of the fibre structures of the support pipe 50. The support pipe may also be made of hard and tensile steel, such as spring steel 120 (FIG. 4). These solutions (FIGS. 3 and 4)

provide a barrel having such resistance that it is explosion-proof, even if some foreign object, such as snow, sand or earth would enter it, or say, a bullet would be left in the barrel.

The barrel shown in FIG. 11 is mainly intended for caliber 22LR. The gun barrel was produced using the method and the device described above (FIGS. 1 and 2). Tests conducted with a barrel of this type proved its operation to be perfect. Bullets made one single hole in the target, with the bullet holes on top of each other. The distance from the target was 30 meters.

The gun barrel consists of a rifled barrel pipe 31 and an outer mantle 41 provided on the outside of the barrel pipe. The outer mantle 41 is a cylindrical pipe, and an interstice 51 is provided between the barrel pipe 31 and the outer mantle. A sound damper unit 42 is provided in front of the barrel pipe 31 and inside the outer mantle 41. The gun barrel can be attached to the bolt housing of the gun by means of compression fit or threads, using a bushing 61 provided at the butt, and the sound damper unit 42 can be attached with the aid of the helicoidal bushing 44 to which it is attached.

The invention claimed is:

1. A method for producing a gun barrel, in which the barrel is formed from a pipe blank (1), wherein barrel rifles (2, 14) are formed in the pipe blank (1) using moulding techniques against a mandrel (3) having grooves (2*b*) shaped as the rifles, said moulding is performed by means of press rolls (4) substantially perpendicular to the longitudinal axis (5) of the pipe blank (1) and the press rolls (4) are rotated around the pipe blank (1) so that the wall of the pipe blank is pressed against the mandrel (3) and the barrel rifles (2) are produced in the inner wall of the pipe blank.

2. A method as defined in claim 1, wherein the pipe blank (1) is a drawn, seamless pipe made of acid-proof steel.

3. A method as defined in claim 1, wherein the pipe blank (1) is pulled over the mandrel (3) and the press rolls are simultaneously rotated around the pipe blank while being pressed (F) against the mandrel.

4. A method for producing a gun barrel, in which the barrel is formed from a pipe blank (1), wherein barrel rifles (2, 14) are formed in the pipe blank (1) using moulding techniques against a mandrel (3) having grooves (2*b*) shaped as the rifles, and wherein the moulding is performed by rolling between two plates (20, 21) so that the entire pipe blank (1) and the mandrel (3) placed within are entirely located between the plates.

5. A method as defined in claim 1, wherein the pipe blank (1) is a drawn, seamless pipe made of stainless steel.

6. A method for producing a gun barrel, in which the barrel is formed from a pipe blank (1), wherein barrel rifles (2, 14) are formed in the pipe blank (1) using moulding techniques against a mandrel (3) having grooves (2*b*) shaped as the rifles, said moulding is performed by means of press rolls (4) substantially perpendicular to the longitudinal axis (5) of the pipe blank (1) and the press rolls (4) are rotated around the pipe blank (1) so that the wall of the pipe blank is pressed against the mandrel (3) and the barrel rifles (2) are produced in the inner wall of the pipe blank, and wherein the pipe blank (1) is pulled over the mandrel (3) and the press rolls are simultaneously rotated around the pipe blank while being pressed (F) against the mandrel such that rolling pressure is applied to an entire outer surface of said pipe black by the pulling of the pipe blank over the mandrel.

7. A method as defined in claim 6, wherein the pipe blank (1) is a drawn, seamless pipe made of acid-proof steel.

8. A method as defined in claim 6, wherein the pipe blank (1) is a drawn, seamless pipe made of stainless steel.

* * * * *